US008445788B1

(12) United States Patent
Tsotsis et al.

(10) Patent No.: US 8,445,788 B1
(45) **Date of Patent: *May 21, 2013**

(54) CARBON NANOTUBE-ENHANCED, METALLIC WIRE

(75) Inventors: Thomas K. Tsotsis, Orange, CA (US); James P. Huang, Huntington Beach, CA (US); Namsoo P. Kim, Bellevue, WA (US); Keith D. Humfeld, Garden Grove, CA (US); William L. Mitchael, Yorba Linda, CA (US); Brad D. Mecham, Lake Stevens, WA (US)

(73) Assignee: The Boeing Company, Chicago, IL (US)

( * ) Notice: Subject to any disclaimer, the term of this patent is extended or adjusted under 35 U.S.C. 154(b) by 383 days.

This patent is subject to a terminal disclaimer.

(21) Appl. No.: 12/776,877

(22) Filed: May 10, 2010

Related U.S. Application Data

(63) Continuation-in-part of application No. 12/348,595, filed on Jan. 5, 2009, now Pat. No. 7,875,801.

(51) Int. Cl.
*H01B 5/00* (2006.01)

(52) U.S. Cl.
USPC ..... 174/126.1; 174/126.2

(58) Field of Classification Search
USPC ..... 174/36, 102 R, 104, 106 R, 102 A, 174/116, 113 C, 126.1, 126.2
See application file for complete search history.

(56) References Cited

U.S. PATENT DOCUMENTS

| | | | | |
|---|---|---|---|---|
| 6,846,985 | B2 * | 1/2005 | Wang et al. | 174/391 |
| 6,988,925 | B2 * | 1/2006 | Arthur et al. | 445/46 |
| 7,118,693 | B2 * | 10/2006 | Glatkowski et al. | 252/502 |
| 7,378,040 | B2 * | 5/2008 | Luo et al. | 252/500 |
| 2004/0020681 | A1 * | 2/2004 | Hjortstam et al. | 174/102 SC |
| 2008/0286560 | A1 | 11/2008 | Huang et al. | |
| 2010/0170694 | A1 | 7/2010 | Tsotsis | |
| 2010/0170695 | A1 | 7/2010 | Tsotsis | |

FOREIGN PATENT DOCUMENTS

| | | | |
|---|---|---|---|
| WO | 2005119772 | A2 | 12/2005 |
| WO | 2007024206 | A2 | 3/2007 |
| WO | 2008076473 | A2 | 6/2008 |

OTHER PUBLICATIONS

Palumbo, M. et al; Layer-by-Layer Thin Films of Carbon Nanotubes; Material Research Society; 2006; pp. 0901-Ra05-41-Rb05-41.1 to 0901-Ra05-41-Rb05-41.6; vol. 901E.

Loh, K. et al.; Multifunctional Layer-by-Layer Carbon Nanotube-Polyelectrolyte Thin Films for Strain and Corrosion Sensing; Smart Materials and Structures; 2007; pp. 429 to 439; vol. 16.

Sandler, J. et al.; Carbon-Nanofibre-filled Thermoplastic Composites; Materials Research Society; 2002; pp. 105 to 110; Vo. 706.

Zhao, Y. et al.; The Growth of Layer-by-Layer Aligned Carbon Nanotubes; IEEE; 2006; pp. 253 to 254.

Mamedov, A. et al.; Molecular Design of Strong Single-Wall Carbon Nanotube/Polyelectrolyte Multilayer Composites; Nature Materials; Nov. 2002; pp. 190 to 194; vol. 1; Nature Publishing Group.

* cited by examiner

*Primary Examiner* — William H Mayo, III
(74) *Attorney, Agent, or Firm* — Armstrong Teasdale LLP

(57) ABSTRACT

A conductive wire includes a metallic wire substrate having a diameter and a surface, and a coating material having a plurality of carbon nanotubes dispersed therein. The coating material is operable to adhere a portion of the carbon nanotubes to the surface of the wire. The coating material has higher specific conductivity than the metallic wire substrate and also has a low contact resistance with the metallic wire substrate.

18 Claims, 3 Drawing Sheets

CARBON NANOTUBE-ENHANCED, METALLIC WIRE

CROSS REFERENCE TO RELATED APPLICATIONS

This application is a continuation-in-part application of U.S. patent application Ser. No. 12/348,595 which was filed on Jan. 5, 2009 now U.S. Pat. No. 7,875,801 and titled "THERMOPLASTIC-BASED, CARBON NANOTUBE-ENHANCED, HIGH- CONDUCTIVITY WIRE", the contents of which is incorporated by reference in its entirety.

STATEMENT REGARDING FEDERALLY SPONSORED RESEARCH & DEVELOPMENT

This invention was made with United States Government support under ATP/NIST Contract 70NANB7H7043 awarded by NIST. The United States Government has certain rights in the invention.

BACKGROUND

The field of the disclosure relates generally to fabrication of conductors, and more specifically to conductors that incorporate carbon nanotubes (CNTs) and the methods for fabricating such conductors.

Utilization of CNTs in conductors has been attempted. However, the incorporation of carbon nanotubes (CNTs) into polymers at high enough concentrations to achieve the desired conductivity typically increases viscosities of the compound containing the nanotubes to very high levels. The result of such a high viscosity compound is that conductor fabrication is difficult has yielded lower-than-desired levels of conductivity, and has produced unacceptably brittle material. A typical example of a high concentration in such a compound is one percent, by weight, of CNTs mixed with a polymer.

Currently, there are no fully developed processes for fabricating wires based on carbon nanotubes, but co-extrusion of CNTs within thermoplastics is being contemplated, either by pre-mixing the CNTs into the thermoplastic or by coating thermoplastic particles with CNTs prior to extrusion. Application of CNTs to films has been shown, but not to wires.

Utilization of CNTs with thermosets has also been shown. However, thermosets are cross-linked and cannot be melted at an elevated temperature. Finally, previous methods for dispersion of CNTs onto films did not focus on metallic CNTs in order to maximize current-carrying capability or high conductivity.

The above mentioned proposed methods for fabricating wires that incorporate CNTs will encounter large viscosities, due to the large volume of CNTs compared to the overall volume of CNTs and the polymer into which the CNTs are dispersed. Another issue with such a method is insufficient alignment of the CNTs. Finally, the proposed methods will not produce the desired high concentration of CNTs.

BRIEF DESCRIPTION

In one aspect, a conductive wire is provided. The wire includes a metallic wire substrate having a diameter and a surface, and a coating material having a plurality of carbon nanotubes dispersed therein. The coating material is operable to adhere a portion of the carbon nanotubes to the surface of the wire and has a higher specific conductivity than the metallic wire substrate as well as a low contact resistance with the metallic wire substrate.

In another aspect, a method for fabricating a conductive filament or wire is provided. The method includes providing at least one metallic wire having an outer surface, applying a coating material to the outer surface of the at least one metallic wire, along an axial length thereof, the coating material including carbon nanotubes dispersed therein, and using a surfactant in the coating material to adhere the carbon nanotubes to the at least one metallic wire.

In still another aspect, a method for fabricating a conductor is provided. The method includes applying a coating material that includes at least one of electrically and magnetically aligned carbon nanotubes to at least one metallic wire, and formulating the coating material to allow it to adhere the carbon nanotubes to the at least one metallic wire.

DETAILED DESCRIPTION

The described embodiments seek to overcome the limitations of the prior art by placing carbon nanotubes (CNTs) on the outside (e.g., about the circumference) of a metallic-based structure, such as a small-diameter metal wire, or other desired substrate to avoid the processing difficulties described above that are associated with dispersion of CNTs within a polymer. Even though high concentrations of single-walled, metallic CNTs are preferred to maximize electrical performance, commercially available grades of CNTs with random mixtures of several types of chirality can also be used with additional features in embodiments, for example, by adding metallic contacts at the end of the CNTs, thereby ensuring no breakage in electrical path. Concentration levels are optimized for wire, not for films or sheets, and therefore high stiffness is not desirable.

Figure 1:
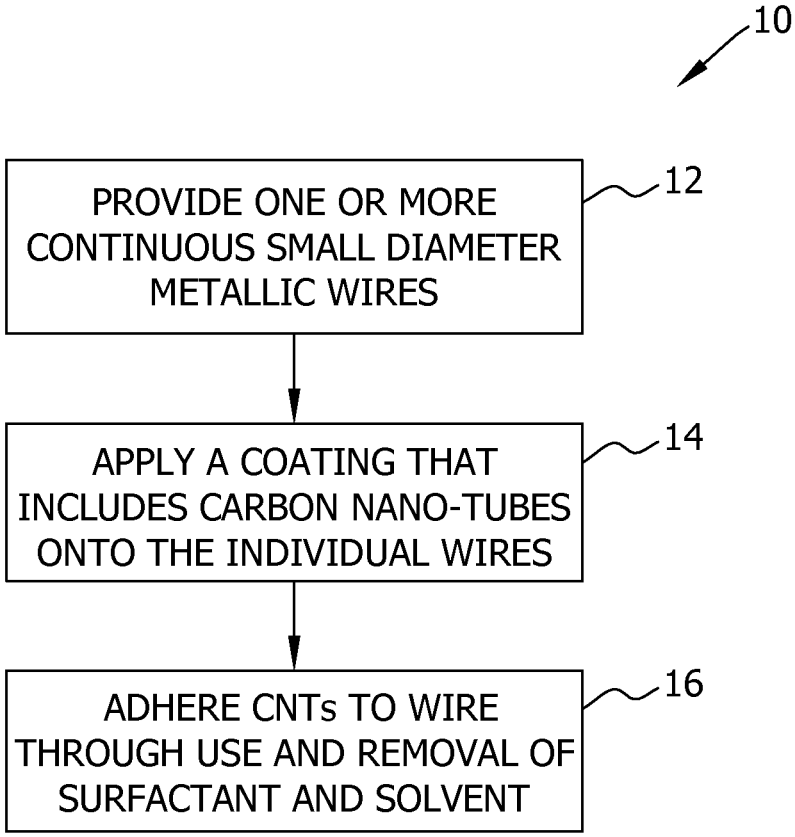
FIG. 1 is a flowchart illustrating a conductor fabrication process that incorporates carbon nanotubes.

One embodiment, illustrated by the flowchart 10 of FIG. 1, includes a method for producing high-conductivity electrical wires based on metallic wires and metallic carbon nanotubes (CNTs). First, one or more continuous, small-diameter metallic wires are provided 12. A coating is applied 14 to the outer surface of the wires. For example, an appropriate solution of CNTs, solvent, and other materials such as surfactants suitable for adhering to the outer surface of small-diameter metallic filaments is utilized as the coating. In at least one embodiment, the solvent and surfactant are fugitive. As mentioned, the coating includes the CNTs therein. In one embodiment, a line suitable for coating thin, flexible, metallic strands with layers of CNT solutions at a sufficient thickness to achieve a desired concentration is set up to form CNT-enhanced, high-conductivity wires. Additionally, and in one embodiment, a field (magnetic field, electric field, etc.) may be provided for aligning the CNTs in the solution to be in the same direction as the processing line. Once the coating is completed, the surfactant and solvent is removed 16.

The processing steps include adhering the CNTs to the individual wires and may include applying an outer coating, such as a wire insulation. Such process may include forming a plurality of the coated wires together into a bundle onto which the outer coating of wire insulation, can be applied. For example, the coated strands may be collected onto spools for post-processing into wire to make material suitable for twisting into wire either in line or in a secondary process. A suitable, flexible outer protective jacket for the resulting wire may be provided which allows for the packaging of the CNT-enhanced wire as normal, metallic wire.

The process illustrated by the flowchart 10 allows for high volume fractions of aligned carbon nanotubes to be applied to the surface of a metallic filament to produce high-conductivity wires using a continuous process. Such a process avoids the necessity for having to mix nanoparticles and/or nanotubes into a matrix resin, since the combination of the two may result in a compound having an unacceptably high viscosity. Continuing, the high viscosity may make processing of the resulting compound difficult.

Figure 2:
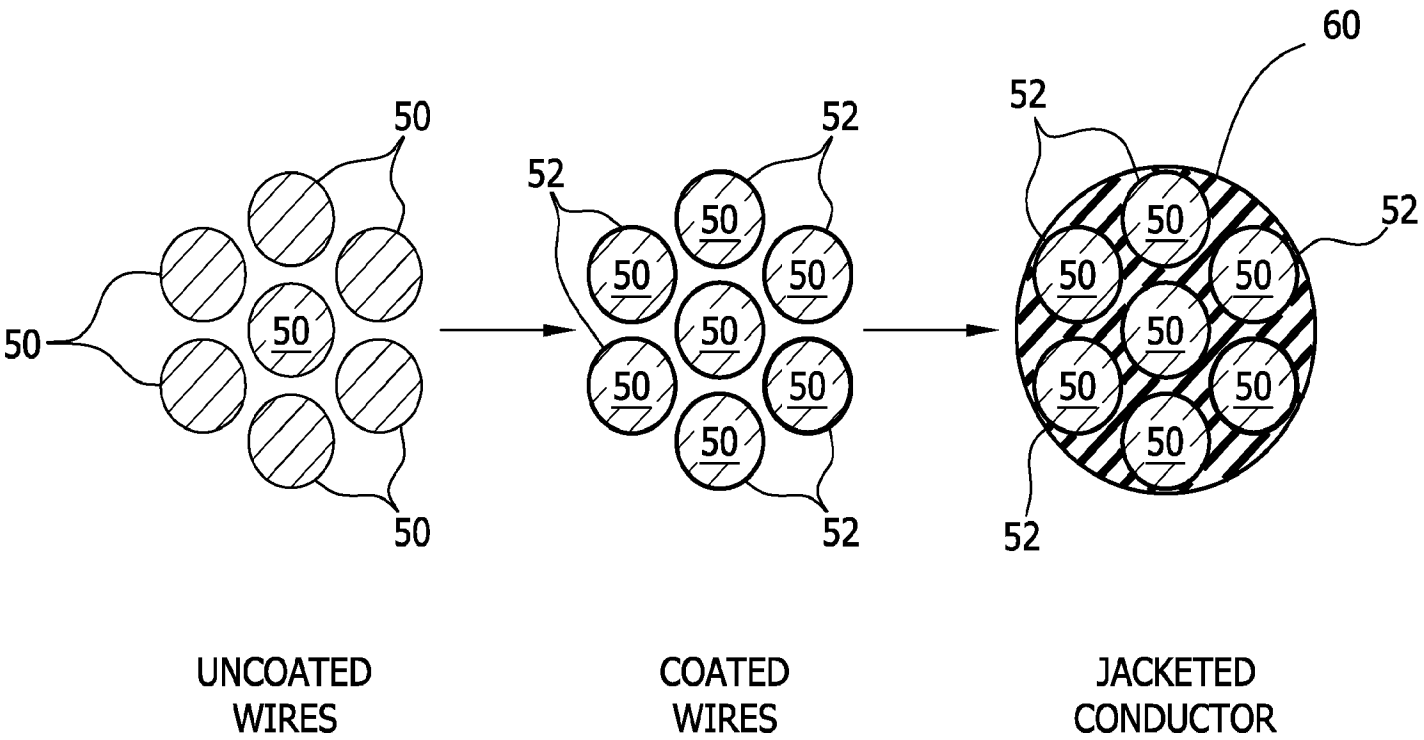
FIG. 2 is a series of cross-sectional diagrams further illustrating a conductor fabricated utilizing the process of FIG. 1.

FIG. 2 includes a series of cross-sectional diagrams further illustrating a conductor fabricated utilizing the process of FIG. 1. A plurality of individual, uncoated, metallic wire filaments 50 are provided. Through coating, one method of which is further explained with respect to FIG. 3, the individual metallic filaments 50 are coated with an outside layer 52 that includes the carbon nanotubes. The outside layer includes, for example at least one surfactant suitable for adhering to the outer surface of small-diameter metallic filaments as well as a solvent.

The coated filaments 50 are then subjected to a process that removes any undesired components leaving the aligned CNTs attached to the filaments 50 such that there is very low contact resistance between the CNTs and the metallic substrate and further results in a plurality of CNT-coated filaments around which an insulative jacket 60 may be applied. It should be noted that embodiments exist where an insulative jacket 60 may be applied about a single CNT-coated conductor as well.

The described embodiments do not rely on dispersing CNTs into a resin as described by the prior art. Instead, CNTs are placed on the outside of small-diameter wires as described above. One specific embodiment utilizes only high-conductivity, single-walled, metallic CNTs to maximize electrical performance. Such an embodiment relies on very pure solutions of specific CNTs instead of mixtures of several types to ensure improved electrical performance. The concentrations levels of CNTs for coating are optimized for wire, in all embodiments, as opposed to concentrations that might be utilized with, or dispersed on, films, sheets and other substrates. Specifically, in a wire-like application, high strength is not required and high stiffness is not desirable.

Figure 3:
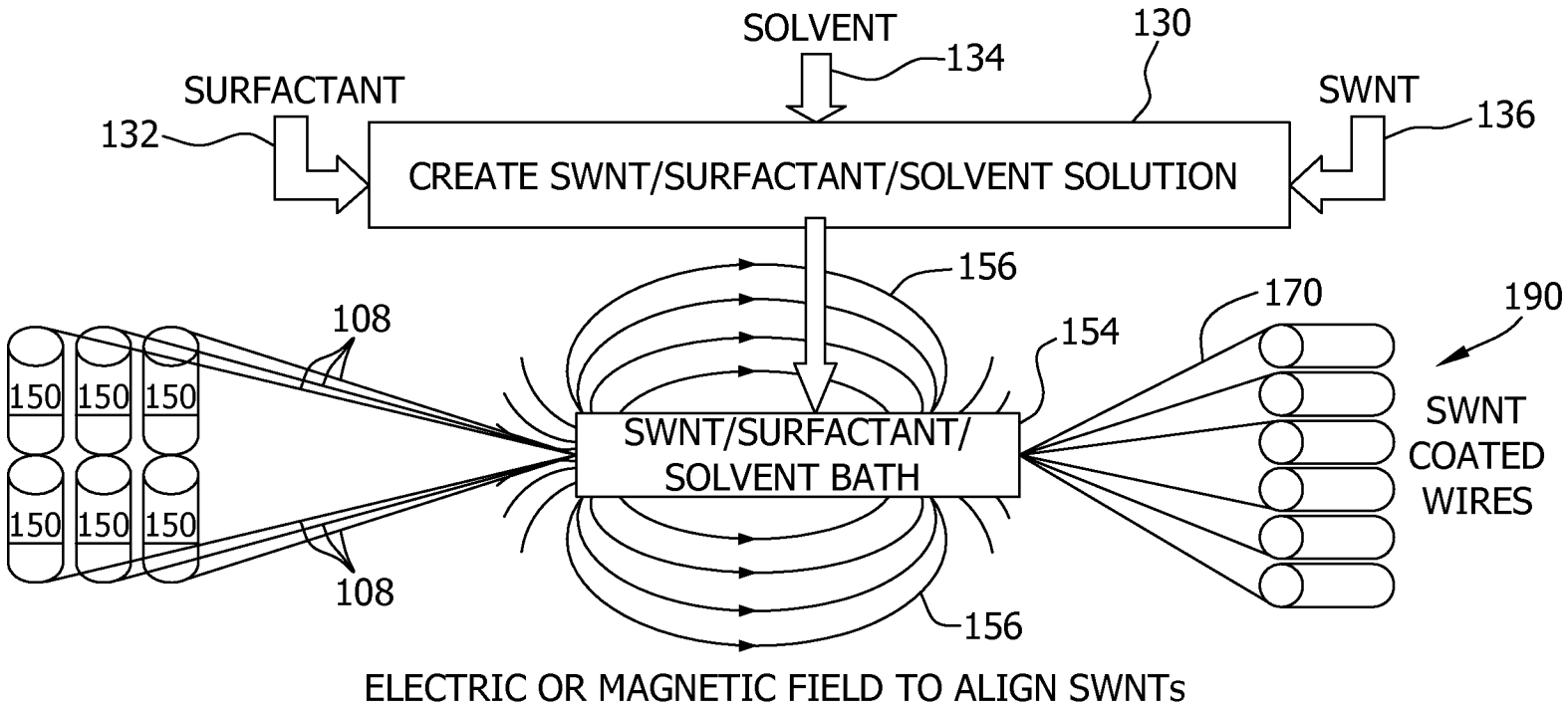
FIG. 3 is a block diagram that illustrates the individual components utilized in fabricating a carbon nanotube-based conductor.

FIG. 3 is a block diagram 100 that illustrates the individual components utilized in fabricating a carbon-nanotube-based conductor that incorporates small-diameter metallic wire. As mentioned herein, coating methodologies are utilized to place sufficiently high concentrations of CNTs onto the outer surface of the small-diameter metallic wire. The result is a high-conductivity wire manufactured using a process that differs from previously disclosed methods that disclose the mixing of CNTs into a resin. It is believed the currently disclosed solutions are preferable because no current solution exists for making CNT-based wires, though some methods have been proposed, as described above.

Now referring specifically to FIG. 3, fabrication of the coated metallic wires is described. A solution 130 is created that includes, at least in one embodiment, a surfactant 132, a solvent 134, and carbon nanotubes (CNTs) 136 such as single-walled nanotubes (SWNTs). The solution 130, in at least one embodiment, is an appropriate solution of CNTs 136, solvent 134, and surfactants 132 suitable for adhering the CNTs to the outer surface of the small-diameter metallic wires 108. In one embodiment, the solution 130 includes one or more chemicals that de-rope, or de-bundle, the nanotubes into as close to individual tubes as possible, thereby also separating single-walled nanotubes from other nanotubes.

To fabricate the above described conductor, one or more separate packages 150 of individual small-diameter metallic wires 108 are passed through a bath 154 of the above described solution 130. As the wires 108 pass through the bath 154, a magnetic field 156 (or an electric field) may be applied to the solution 130 therein in order to align the de-bundled carbon nanotubes 136. In a specific embodiment, which is illustrated, the CNTs 136 are single-walled nanotubes.

The magnetic or electric field 156 operates to provide, at least as close as possible, individual carbon nanotubes for attachment to the outer surface of the wires 108. The magnetic or electric field 156 operates to align the CNTs. Such CNTs have the highest conductivity.

The embodiments represented in FIG. 3 all relate to a continuous line suitable for coating small-diameter, metallic wire strands (wires 108) with a layer of the CNT solution 130 at a sufficient thickness to achieve a desired concentration or conductivity. The magnetic field 156, (or alternatively an electric field), is utilized to align the CNTs 136 in the solution 130 into the same direction as the processing represented in the Figure.

In one embodiment, the wires 108 emerge from the solution 130 as coated strands 170 that may be gathered onto spools for post-processing. Alternatively, and as shown in FIG. 3, the coated strands 170 may be subjected to removal of the surfactant 132 and solvent 134 and rolled up into wire 190. Finally, though not shown in FIG. 3, a suitable, flexible outer coating may be applied to the wire 190 (or multiple instances of the wires 190) and subsequently packaged in a fashion similar to that used for known metallic wire.

This written description uses examples to disclose certain embodiments, including the best mode, and also to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A conductive wire comprising:

a metallic wire substrate comprising a diameter and a surface; and a coating material comprising a plurality of carbon nanotubes dispersed therein, said coating material operable to adhere a portion of said carbon nanotubes to said surface of said metallic wire substrate, said coating material having higher specific conductivity than said metallic wire substrate and also having low contact resistance with said metallic wire substrate.

2. A conductive wire according to claim 1 further comprising an outer coating substantially surrounding the adhered carbon nanotubes along an axial length thereof.

3. A conductive wire according to claim 1 wherein said plurality of carbon nanotubes comprise single-walled, metallic carbon nanotubes.

4. A conductive wire according to claim 1 wherein said coating material comprises a solution of said carbon nanotubes, a surfactant, and a solvent.

5. A conductive wire according to claim 4 wherein said surfactant is utilized to adhere said coating material to the surface of said metallic wire.

6. A conductive wire according to claim 4 wherein the solvent is removed and said surfactant is fugitive.

7. A conductive wire according to claim 1 wherein said plurality of carbon nanotubes are aligned in said coating material utilizing at least one of an electric field and a magnetic field before application of said coating material to said metallic wire, the alignment along a direction of said wire as said wire is passed through said coating material.

8. A conductive wire according to claim 1 wherein said coating material is applied to said metallic wire by passing said metallic wire through a bath containing said coating material.

9. A method for fabricating a conductor, said method comprising:

providing at least one metallic wire having an outer surface;

applying a coating material to the outer surface of the at least one metallic wire, along an axial length thereof, the coating material including carbon nanotubes dispersed therein, the coating material having higher specific conductivity than the at least one metallic wire substrate and a low contact resistance with the metallic wire; and using a surfactant in the coating material to adhere the carbon nanotubes to the at least one metallic wire.

10. A method according to claim 9 further comprising bundling a plurality of the coated metallic wires.

11. A method according to claim 9 further comprising applying an insulative outer coating to the plurality of the coated metallic wires.

12. A method according to claim 9 wherein applying a coating material to the outer surface of the at least one metallic wire comprises aligning the carbon nanotubes within the coating material utilizing at least one of an electric field and a magnetic field, the alignment along a length of the at least one metallic wire.

13. A method according to claim 9 wherein the carbon nanotubes are single-walled, metallic carbon nanotubes.

14. A method according to claim 9 wherein applying a coating material to a surface of the at least one metallic wire comprises passing the at least one metallic wire through a solution that includes the carbon nanotubes, a surfactant and a solvent.

15. A method for fabricating a conductor comprising:

applying a coating material that includes at least one of magnetically and electrically aligned carbon nanotubes to at least one metallic wire; and formulating the coating material to allow it to adhere the carbon nanotubes to the at least one metallic wire.

16. A method according to claim 15 wherein applying a coating material comprises passing the at least one metallic wire through a solution that contains at least a solvent and the at least one of magnetically and electrically aligned carbon nanotubes.

17. A method according to claim 15 further comprising forming a single conductive structure from a plurality of metallic wires having carbon nanotubes adhered thereto.

18. A method according to claim 15 wherein applying the coating material comprises applying the coating material at a sufficient thickness to achieve a desired concentration of carbon nanotubes.

* * * * *